United States Patent [19]

Clark et al.

[11] 4,422,067

[45] Dec. 20, 1983

[54] DYNAMIC SELF-CHECKING SAFETY CIRCUIT MEANS

[75] Inventors: Rodney L. Clark, Dakota; William R. Landis, Hennepin; Paul B. Patton, Anoka; Charles B. Yancey, Hennepin, all of Minn.

[73] Assignee: Honeywell Inc., Minneapolis, Minn.

[21] Appl. No.: 308,703

[22] Filed: Oct. 5, 1981

[51] Int. Cl.[3] ..... G08B 29/00

[52] U.S. Cl. ..... 340/508; 340/501; 340/507; 340/515; 340/518; 340/532; 340/635; 361/1; 110/191; 110/193; 236/1 A; 236/89; 236/94

[58] Field of Search ..... 340/508, 507, 500, 501, 340/502, 503, 511, 515, 514, 520–522, 523, 532, 531, 516, 584, 588, 589, 635, 640, 577, 578, 593, 594, 657, 518; 110/185, 190, 191, 192, 193; 126/388; 236/94, 99 A, 99 E, 89, 1 A; 361/1

[56] References Cited

U.S. PATENT DOCUMENTS

| | | | |
|---|---|---|---|
| 2,798,213 | 7/1957 | Rowell | 340/577 |
| 2,798,214 | 7/1957 | Rowell | 340/515 |
| 2,807,009 | 9/1957 | Rowell | 340/506 |
| 2,807,010 | 9/1957 | Rowell | 340/506 |
| 2,807,011 | 9/1957 | Rowell | 340/506 |
| 3,390,387 | 6/1968 | Hugenholtz | 340/507 |
| 3,569,793 | 3/1971 | Pinckaers | 361/186 |
| 3,967,281 | 6/1976 | Dageford | 340/520 |

OTHER PUBLICATIONS

1976 Fairchild Camera and Instrument Corporation; Macrologic Bipolar Microprocessor Databook; pp. 3-11 through 3-14.

*Primary Examiner*—Donnie Lee Crosland
*Attorney, Agent, or Firm*—Alfred N. Feldman

[57] ABSTRACT

A safety circuit which connects a condition responsive circuit to a cyclic signal detecting circuit. In order to provide the cyclic signal detecting circuit with a continuous cyclic input, the condition responsive circuit and a cyclic redundancy checker is provided. The cyclic redundancy checker identifies a specific series of logic bits from the condition responsive circuit and responds favorably only to that series of logic bits. If any other series of logic bits occurs, the cyclic redundancy checker of the system ceases to function, thereby causing the cyclic signal detecting circuit to cease to function and it in turn opens a series contact to deenergize a critical load in a control system.

12 Claims, 2 Drawing Figures

DYNAMIC SELF-CHECKING SAFETY CIRCUIT MEANS

BACKGROUND OF THE INVENTION

Over the years, a number of ways have developed for the design and construction of control devices using mechanical and electromechanical equipment that have proved to be safe and reliable in operation. These types of devices have been used for many years in the control of equipment that can create unsafe conditions if a failure occurs. An example of this type of equipment is a burner control system that is operated under the supervision of units that generically are referred to as flame safeguard systems. In this burner control art it is essential that upon certain types of failures that the fuel valve to a fuel burner be closed. The failure of a flame safeguard control system to operate properly can lead to a situation in which a fuel valve is left open when no flame exists, and a fuel-burning chamber can be loaded with fuel. This fuel can then accidentally be ignited causing an explosion. This type of failure can generally be guarded against in the existing technology of flame safeguard systems by utilizing safety checking types of circuits that repetitively simulate the absence of flame and then check for the presence of flame. These types of systems then repetitively charge and discharge a capacitive series arrangement to hold in a control relay that in turn energizes the fuel valve. This type of closed loop safety system has been used for a number of years, and is generally considered to be quite reliable.

In recent years, the conventional electromechanical and electronic types of control systems, including flame safeguard control systems, have been displaced by electronic control systems of the digital type that utilize microprocessors or microcomputers as the heart of the condition responsive control circuit means. The use of digital logic including microcomputers and microprocessors leads to many benefits in that more sophisticated and fuel efficient types of control systems can be developed. The detriment of the use of digital logic and microcomputers or microprocessors is that circuit failures within the digital equipment can occur and result in an unsafe mode of operation of the overall control system.

The normal technique for verifying the operation of a computer-type of microprocessors or microcomputer arrangement is in the use of dual processors. In this case, one computer or processor is programmed to check up on the other processor or computer, and vice versa. This redundancy allows for the detection of a malfunction, and allows the healthy processor or microcomputer to take the necessary corrective action in the event of a failure of the other of the dual elements. The use of dual microcomputers or microprocessors is a very expensive and complex technique for generating a safe operating control system. It is essential for the practical application of safety control systems, such as the flame safeguard control systems, that a reliable and less expensive approach be developed.

SUMMARY OF THE INVENTION

The present invention recognizes the desirability of being able to utilize a single microcomputer or microprocessor which responds to a sensed condition to control a critical load. If this type of system is applied to the flame safeguard or burner control technology, the sensed condition would be a burner within a furnace or boiler, and the microcomputer or microprocessor would program a prepurge, an ignition period, a check for the presence of a pilot flame, and then the establishment of a main flame in the burner. With a microcomputer or a microprocessor, all of this programming and control can be readily accomplished and is safety checked by the addition of a special cyclically operated system that has an output switch or contact from a relay in series with the normal load relay contact of the fuel valve, pilot valves, and ignitor.

The novel system of the present invention utilizes a device known as a cyclic redundancy checker that is coupled to a cyclically responsive safety circuit of the type disclosed in the Pinckaers' U.S. Pat. No. 3,569,793. The output of the cyclically operated circuit ensures that a safety switch means or output relay contact (that is in series with the safety-critical load contacts) is closed only if the entire system is functioning properly. A failure anywhere in the control system will cause the cyclic signal that is fed to the cyclic signal detecting circuit to cease, and this in turn causes the output switch or relay of that circuit to open. The opening of that circuit opens a series circuit to the safety-critical loads and deenergizes those loads.

While the cyclic signal detecting circuit means of the type disclosed in the Pinckaers' patent is used in a known mode, the interface between the circuit and the microprocessor or microcomputer in the use of the cyclic redundancy checker is significantly different than has been provided in known systems. The cyclic redundancy checker is disclosed as a 9401 cyclic redundancy checker as manufactured by Fairchild Camera and Instruments Corporation. This cyclic redundancy checker is normally applied to an entirely different technique of circuit checking than is present in this invention. The 9401 is a device which receives a stream of data bits from a computer or microcomputer, as they are transmitted to a storage device. In the transmission of the data bits from the microcomputer to the storage, the cyclic redundancy checker generates a unique signature that corresponds to that particular series of data. This signature is appended to the series of data and is stored along with the series of data bits. When the data is transferred from the storage means back to the microcomputer or microprocessor, the normal function of the cyclic redundancy checker is to verify that the bits being transferred back again generate the same unique signature that was tacked onto the bits as they were placed in storage. If there is an error in the transmission of the stored memory back to the microcomputer or microprocessor, the cyclic redundancy checker flags this error, and the stored information that is returned to the microcomputer or microprocessor can be identified as being incorrect.

In the present invention, the cyclic redundancy checker is not used in this way. In the present invention, an ordered set of memory locations within the microcomputer or microprocessor is used in the generation of a sequence of logic bits that are sent to the cyclic redundancy checker. By selecting a representative distribution of locations within the microprocessor or microcomputer, the output sequence of logic bits can provide a good indication of the operation of the microcomputer. The sequence of logic bits includes the predetermined signature for this sequence of bits which complies with the signature verification logic of the cyclic redundancy checker. The cyclic redundancy checker examines the content and order of the sequence of logic bits as they are output by the microcomputer, and the cyclic redundancy checker has an output which changes if the sequence and content of the logic bits is correct. The cyclic redundancy checker means is then preset once again by a signal from the microcomputer which changes the cyclic redundancy checker's output again. Thus, if the microcomputer is regularly outputting the correct sequence of logic bits and alternately is outputting preset signals (all of which indicate proper functioning of the microcomputer), then the cyclic redundancy checker will regularly change its output in response to the sequence of logic bits, and then it will, in turn, change back again in response to the preset signal. This causes the cyclic redundancy checker means to have a continuously oscillating output which in fact is a square wave that occurs at approximately 20 hertz. This continuous cyclic output is fed into a circuit of the type disclosed in the Pinckaers' U.S. Pat. No. 3,569,793, and is used to keep a safety switch means closed thereby allowing a load control switch means that is under the control of the microprocessor or in turn control the output load.

In the event that the content and order of the data bits sent by the microprocessor or microcomputer are in error, the cyclic redundancy checker output will not change. This cessation of the cyclic output will cause the safety switch means of relay contact to open, thereby opening a series circuit to the critical load and causing the load to become deenergized.

With the present invention, a cyclic redundancy checker means which is normally used to check the transmission of data to and from storage is used as a checking device to verify the proper operation of a microcomputer or microprocessor. The cyclic redundancy checker means checks the microcomputer, but the microcomputer in turn checks the cyclic redundancy checker means. The probability that both will fail together is very remote. In the event of a failure of the data to be properly identified, the cyclic signal detecting circuit opens a series relay contact to deenergize a critical load. With this arrangement, a simple, and relatively inexpensive safety circuit is developed which is dynamic in nature and continuously checks a microcomputer or microprocessor in a control system, such as a flame safeguard burner control system.

DESCRIPTION OF THE PREFERRED EMBODIMENT

Figures 1, 2:
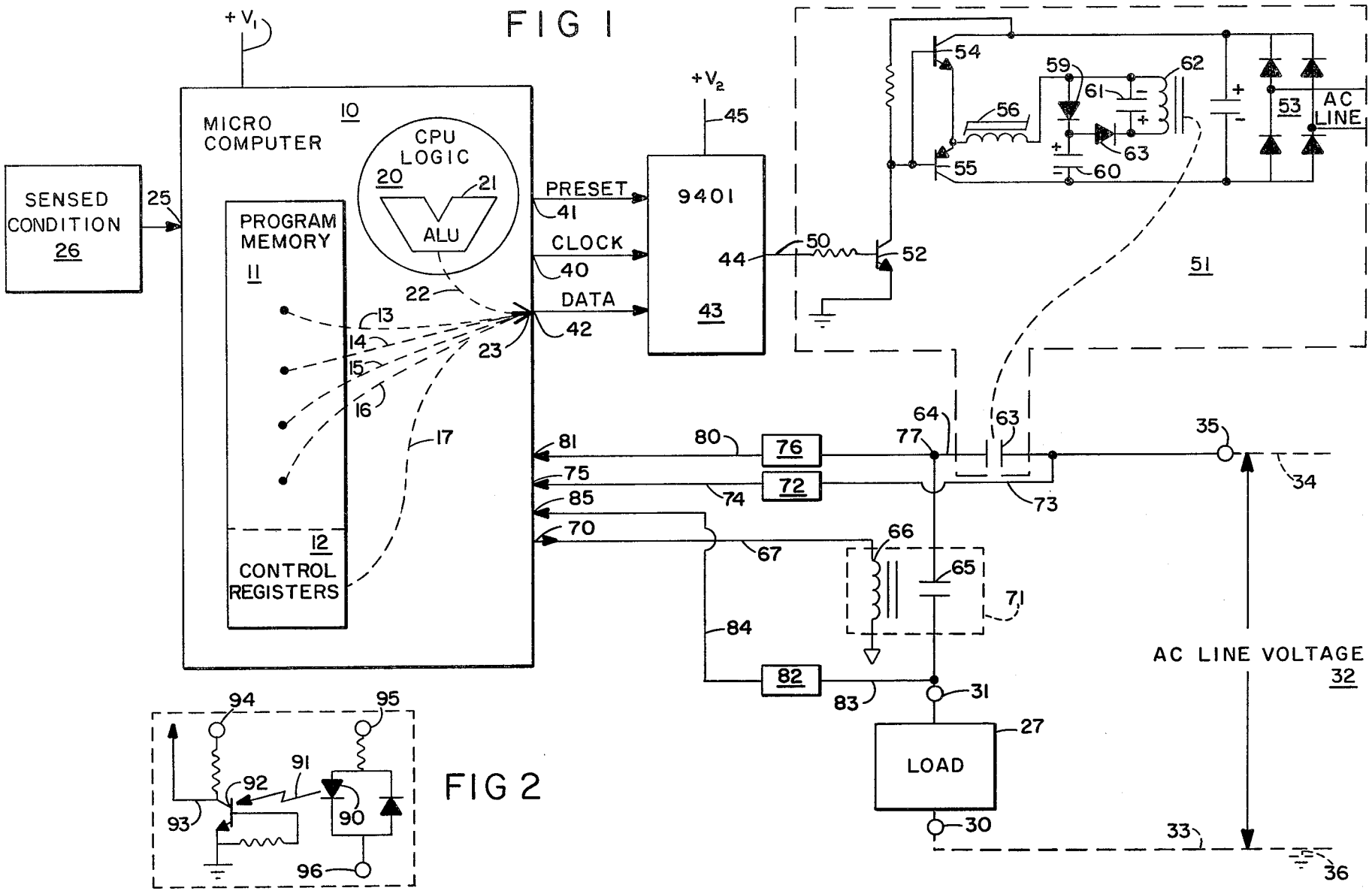
FIG. 1 is a schematic representation of a complete dynamic self-checking safety circuit means.
FIG. 2 is a representation of an opto-isolator feedback device.

The dynamic self-checking safety circuit means of FIG. 1 is generally built around a microcomputer or microprocessor disclosed at 10. Within the microcomputer or microprocessor 10 there are a number of conventional microcomputer subcircuits. These subcircuits have been shown pictorially as a matter of reference. The microcomputer 10 has a subcircuit 11 such as the program memory for the microcomputer. This memory further has control resistors 12. A central processing unit logic is disclosed at 20 which includes an arithmetic logic unit 21. The program for the microcomputer 10 is designed to require the proper operation of these elements in the generation of the data signal or output 23. All of these various parts of the device 10 contribute to the outputting of a correct stream of logic bits and the correct signature. This is indicated symbolically by outputs 17 through 22, all of which have effect on the correctness of the data signal or output 23. This series of logic bits is conditioned properly upon the normal operation of the condition responsive circuit means 10. The condition responsive circuit means 10 can be any type of condition responsive circuit means including the microprocessor or microcomputer specifically disclosed, or could be a discrete component built system that samples various portions of the discrete circuit and provides the necessary stream of, or series of, logic bits which are conditioned upon the normal operation of the device. The device further could even be a conventional flame safeguard type of unit of electromechanical type in which the programming is accomplished by an electric clock that drives a series of cams that switch the output function. In such a device, the electric clock could drive additional drum switches to generate a series of logic bits as is necessary at 23 from the device disclosed in FIG. 1. As such, it is possible to develop a condition responsive circuit means 10 in any number of ways, but a microcomputer or microprocessor of conventional design has been disclosed as the preferred implementation of the invention.

Feeding into the microcomputer or microprocessor 10 is power from a power supply disclosed as V1. The power supply V1 is a power supply that would be separate from the power supplies elsewhere in the present design, for reasons that will be brought out later in the present description. The microcomputer 10 is inputted at 25 by a sensed condition system disclosed at 26. This could be a conventional arrangement of a flame safeguard device including a flame responsive device, amplifier, and the necessary equipment to convert the input 25 to a digital type of input signal. In being a digital input it would be either an "off" or an "on" type of signal from the sensed condition 26. The sensed condition 26 would control the microcomputer or microprocessor 10, as in a flame safeguard control system, to ultimately control a load disclosed at 27. The load 27 is adapated to be connected by a pair of terminals 30 and 31 to a conventional alternating current line voltage disclosed at 32, between the conductors 33 and 34. A further terminal 35 is provided so that the present system could be connected to the alternating current line voltage 32 by the conductors 33 and 34 to energize the load 27 when an appropriate set of conditions exist. This appropriate set of conditions will be discussed subsequently in the present discussion. The conductor 33 also typically would be the common 36 of the applied alternating current line voltage 32.

The microcomputer or microprocessor 10 would have a number of input and output ports that are not disclosed in the present disclosure, and it should be understood that this technology is well known in the art and the fact that they are not shown is merely for convenience. Only a few other input and output ports for the microcomputer or microprocessor 10 have been disclosed. An output port 40, and an output port 41, have been disclosed and have been identified as a clock output at 40 and a preset output at 41. The preset signal 41 would not necessarily have to be provided by the microcomputer 10. It could be an automatic function of the unit into which the signal 41 is fed. The unit receiving signal 41 could reset itself after a time interval, say 25 milliseconds, if it does not receive a clock signal 40.

Also, the preset signal 41 could be provided by any other convenient part of the device. A data output port 42 is disclosed connected to the series of logic bits 23 that is generated internal of the microcomputer or microprocessor 10. The output ports 40, 41, and 42 transmit a clock pulse, a preset pulse, and the data to a cyclic redundancy checker means 43 that has been disclosed as a 9401 type of cyclic redundancy checker. In this particular case the cyclic redundancy checker means 43 is used strictly in its verification mode, i.e., the cyclic redundancy checker means 43 is looking for data being supplied at the output port 42 from the microprocessor 10, which ends with a correct signature. If the data is correct, and the correct signature is recognized by the cyclic redundancy checker means 43, an output port 44 is caused to shift to a logic level indicating no error which is identified here as "error false" or simply "false". The cyclic redundancy checker means 43 is then reset by a preset signal 41 of the microcomputer or microprocessor 10. This causes the output port 44 of the cyclic redundancy checker means 43 to go to the opposite logic level, "error true", indicating a data error (correct signature not yet received). This shifting from "false" to "true" causes the output port 44 to shift. The design of the present system is that the clocking of data from the port 40 through the port 42, and the application of a preset signal from the port 41 to the cyclic redundancy checker means 43 occurs at about 25 millisecond intervals thereby generating a 20 hertz square wave output signal at port 44. The timing arrangement of this system has been selected to provide a square wave output signal whose frequency falls well below the 60 hertz applied normally to the system, and well above the lower limit of no output at all. The timing of the device is controlled by a clock internal to the microcomputer or microprocessor 10. This type of a clock normally is based on a crystal controlled oscillator and counting mechanism, and the clock is a normal part of the microcomputer or microprocessor 10 which has not been specifically shown.

It will be noted that the cyclic redundancy checker means 43 is energized at 45 from a voltage V2. The voltage V2 is a different voltage than voltage V1 which energizes the microcomputer or microprocessor 10, and has been provided so that a change or shift in a power supply will not affect both devices, thereby providing a safety feature for the present unit.

The cyclic output of the cyclic redundancy checker means 43 at output port 44 is connected by a conductor 50 to a cyclic signal detecting circuit generally disclosed at 51. The cyclic signal detecting circuit means 51 is of the type disclosed in the Pinckaers' U.S. Pat. No. 3,569,793 and will only be described in general function. The cyclic input on the conductor 50 causes a transistor 52 to operate cyclically from power supply at 53. This cyclic operation causes a further pair of transistors 54 and 55 to alternately become conductive. A choke 56 is provided to block out frequencies above a certain critical frequency, thereby causing the device to be immune from a line frequency of 50 or 60 hertz. The power for the transistors 52, 54 and 55 is supplied by a conventional power supply disclosed at 53, and the power that is drawn from the power supply 53 is repetitively fed to a pair of capacitors 60 and 61 through a pair of diodes 59 and 63. The operation of the transistors 54 and 55 cause the capacitor 60 to be charged. The charge is then terminated, and the charge is allowed to be transferred from the capacitor 60 to the capacitor 61. This charge transfer ensures that any circuit failure within the device causes a stop of the flow of energy in a periodic transfer of energy from the capacitor 60 to the capacitor 61. The capacitor 61 is used to energize a relay coil 62 that in turn controls a normally open relay contact 63, that forms the safety output switch means for the present device. In order for the relay 62 to be continuously energized keeping the contact 63 closed, a cyclic input must occur on the conductor 50 from the output port 44 of the cyclic redundancy checker means 43.

It will be noted that the contact 63 is connected to the terminal 35 and in turn is connected by a conductor 64 to a further relay contact 65 and the terminal 31 adjacent to load 27. The contact 63 and 65 form a series circuit wherein two switch means are connected in series, and are adapted to control the electric power to the load 27. The opening of the switch means 63 under the influence of the cyclic signal detecting circuit means 51 will deenergize the load 27. This is the safety function provided by the system. The normal load control contact 65 is in turn controlled from a relay coil 66 which is connected by a conductor 67 to an output port 70 from the microprocessor or microcomputer 10. When the microcomputer or microprocessor 10 provides an energizing signal to the port 70 the relay 66 is energized to close the switch 65, and the relay 66 and its contact 65 formed generally a load control switch means disclosed at 71. The load control switch means 71 being in series with the contact 63 which forms a safety switch means ensures that the load 27 is deenergized whenever there is a malfunction in the device even if the microprocessor or microcomputer 10 should energize the output port 70 to energize the coil 66 of the relay.

In order to ensure that the present system is functioning properly, a series of feedbacks are provided from the safety switch means 63 and the load control switch means 71. The first of these feedbacks is disclosed at 72, wherein 72 would be a voltage isolation means such as an opto-isolator. A typical opto-isolator is disclosed in FIG. 2 and will be discussed subsequently. The voltage isolation and feedback means 72 is connected by a conductor 73 to the line terminal 35 (and switch means 63) and feeds back on a conductor 74 to a port 75 information as to the presence or absence of a voltage at the terminal 35. A further voltage isolation means 76 is disclosed as connected at a junction 77 of the switch means 63 and the contact 65 of the load control switch means 72. The feedback circuit from the voltage feedback means 76 is provided by a conductor 80 to an input port 81 of the microprocessor 10. A final feedback circuit is completed by a voltage feedback means 82 that is connected to the terminal 31 of the load 27 by a conductor 83, and by a further conductor 84 to a port 85 of the microcomputer or microprocessor 10. The feedback means 76 and 82 provide indications of the output states of the series of switch means 63 and 65. The function of the voltage feedback means will be described in connection with the operation of the overall system of FIG. 1.

A typical opto-isolator is disclosed in FIG. 2, and would be useful as the voltage feedback means 72, 76, or 82. The opto-isolators shown in FIG. 2 are of conventional design. Typically, the opto-isolator in FIG. 2 would include a light emitting diode 90 that is energized across the potential supplied at 95 and 96, and would emit a light 91 to a light responsive transistor 92. The transistor 92 would pull the voltage on a conductor 93 down to ground when the transistor 92 conducts, and would allow the voltage on conductor 93 to rise to a positive potential 94 when the transistor 92 is nonconductive. As such, this device senses the presence or absence of a voltage across the pair of terminals 95 and 96, and also isolates those terminals electrically from the output 93. This opto-isolator is a convenient way of feeding back information from the switch means 63 and 65 to the ports 75, 81, and 85 of the microprocessor or microcomputer 10.

DESCRIPTION OF OPERATION

It is assumed that the checking safety circuit means disclosed in FIG. 1 is in a flame safeguard control system, and it is in a normal operating mode. Under these conditions, a sensed condition means 26 provides a signal to the port 25 of the microcomputer or microprocessor 10 which in turn would have an output signal at port 70 to energize the switch means 71 thereby closing the contact 65 to the load 27. The microcomputer or microprocessor 10 would have data being supplied from the program memory 11, the control registers 12, the central processing unit 20, and the arithmetic logic unit 21 as bits of data that would come together at 23 as a series of logic bits to the port 42 thereby being supplied as data to the cyclic redundancy checker means 43. The clock 40 would be functional to transfer this information with each bit of data. As the data is supplied to the cyclic redundancy checker means 43, the output 44 is "true" and the cyclic redundancy checker means 43 is a process of computing a signature of the data as supplied from the port 42. The data is in a series of 16 bits of data, plus 16 bits of signature. It is supplied to the cyclic redundancy checker means 43. If the signature supplied with the data is the correct signature, as determined by the signature verification logic in the cyclic redundancy checker means 43, then the output, or port 44, goes tc a logic level indicating no error (error false). This "error false" state is retained for about 25 milliseconds at which time a preset signal is generated by the microprocessor or microcomputer 10 and is supplied at the port 41. The present signal at port 41 is fed to the cyclic redundancy checker means 43 and it resets the cyclic redundancy checker means 43 by causing the output port 44 to again go "true". This then generates a square wave at a frequency of approximately 20 hertz. This repetitive cycle continues every 25 milliseconds. As long as the system operates properly, a cyclic signal is supplied at the conductor 50 to drive the cyclic signal detecting means 51. As long as the cyclic signal detecting circuit 51 receives this type of an input, the relay 62 remains energized by a transfer of energy from the capacitor 60 to the capacitor 61 thereby keeping closed the contact or safety switch means 63. This keeps a series circuit arrangement energized from the terminal 35 to the terminal 31, where the load 27 receives this power and is further connected through the terminal 30 to the conductor 33. In a preferred configuration, switch means 63 closes just before switch means 65, and opens just after switch means 63. This adds to safety because the load switch means 65 is not powered until it is needed.

It can be seen that as long as the load 27 is to be retained energized, this cyclic arrangement must be continued. If the cyclic redundancy checker means 43 fails, if the cyclic signal detecting means 51 fails, or if any part of the microcomputer or microprocessor 10 fails, the series of cyclic data bits that are necessary to keep the cyclic signal detecting circuit means 51 energized also fails. This failure allows the relay 62 to become deenergized and the contact or safety switch means 63 will open. This deenergizes the load 27.

The status of each of the contacts or switch means 63 and 65 is continuously monitored by the feedback paths through the opto-isolators 72, 76, and 82. These three feedback paths provide the microcomputer or microprocessor 10 with data as to the presence of a line voltage at terminal 35, the subsequent presence of that voltage at the junction 77 when the safety switch means 63 is closed, and the further presence of the line voltage at the terminal 31 when both the contacts 63 and 65 are closed. As such, the input ports 75, 81, and 85 of the microprocessor or microcomputer 10 feed back information as to the status of power to the load and its contacts at all times. The use of these feedback circuits is an additional safety function.

The specific application of the present dynamic self-checking safety circuit can be widespread and is not limited to a specific type of microcomputer or microprocessor, as was indicated. Other types of condition responsive devices and circuit means could be used. The use of a 9401 cyclic redundancy checker is by way of example, as other types of data bit identification devices may also be used. A 32 bit shift register (series-in, parallel-out) with its parallel outputs connected to a 32 bit comparator could be made to provide the function of a cyclic redundancy checker means. The particular type of cyclic signal detecting circuit was provided by way of example, and also could be altered in its configuration. The use of a feedback technique either in total or with the use of opto-isolators is a further optional design. As such, the applicants wish to be limited in the scope of their invention solely by the scope of the appended claims.

The embodiments of the invention in which an exclusive property or right is claimed are defined as follows:

1. A dynamic self-checking safety circuit means adapted for control of electric power to a load, including: condition responsive circuit means including repetitively operated signal generating means for generating a series of logic bits conditioned upon the normal operation of said condition responsive circuit means; clock means having clock output means providing timed output signals; preset signal generating means providing a preset signal; cyclic redundancy checker means connected to said condition responsive circuit means, to said clock means, and to said preset signal generating means to receive said logic bits, said timed output signals, and said preset signals; said cyclic redundancy checker means having circuit means capable of properly identifying said series of logic bits conditioned upon the normal operation of said condition responsive circuit means; said cyclic redundancy checker means having output means providing output signals that cycle each time said cyclic redundancy checker means receives said series of logic bits and then said preset signal; cyclic signal detecting circuit having an input connected to said cyclic redundancy checker output means, and having safety switch means as an output; load control switch means connected to said condition responsive circuit means and controlled thereby; and said two switch means being connected in series circuit and adapted to connect said load to said electric power upon said condition responsive circuit means causing said load control switch means to operate with said cyclic redundancy checker means operating the said cyclic signal detecting circuit to in turn operate said safety switch means.

2. A dynamic self-checking safety circuit means as described in claim 1 wherein said clock means and said preset signal generating means are part of said condition responsive circuit means; and said preset signal is provided after each series of logic bits.

3. A dynamic self-checking safety circuit means as described in claim 2 wherein said safety switch means is relay means having a relay contact as an output; and said load control switch means is further relay means having a load controlling contact with said further relay means connected to said condition responsive circuit means and controlled thereby.

4. A dynamic self-checking safety circuit means as described in claim 3 wherein said condition responsive circuit means includes a microcomputer which generates said series of logic bits, said clock output means, and said preset signals.

5. A dynamic self-checking safety circuit means as described in claim 1 including voltage feedback means having input means connected to said switch means, and output means connected to said condition responsive circuit means to provide said condition responsive circuit means with continuous feedback status information as to the condition of operation of said switch means.

6. A dynamic self-checking safety circuit means as described in claim 5 wherein said voltage feedback means are voltage isolating opto-isolators.

7. A dynamic self-checking safety circuit means as described in claim 6 wherein said safety switch means is relay means having a relay contact as an output; and said load control switch means is further relay means having a load controlling contact with said further relay means connected to said condition responsive circuit means and controlled thereby.

8. A dynamic self-checking safety circuit means as described in claim 7 wherein said condition responsive circuit means includes a microcomputer which generates said series of logic bits, said clock output means, and said preset signal.

9. A dynamic self-checking safety circuit means as described in claim 8 wherein said microcomputer contains subcircuit means including program memory means, control register means, central processing unit means, and arithmetic logic unit means with said series of logic bits being generated by said subcircuit means.

10. A dynamic self-checking safety circuit means as described in claim 9 wherein said microcomputer responds to sensed condition means which in turn is part of a flame safeguard control system, and said load is a fuel valve.

11. A dynamic self-checking safety circuit means as described in claim 4 wherein said microcomputer contains subcircuit means including program memory means, control register means, central processing unit means, and arithmetic logic unit means with said series of logic bits being generated by said subcircuit means.

12. A dynamic self-checking safety circuit means as described in claim 11 wherein said microcomputer responds to sensed condition means which in turn is part of a flame safeguard control system, and said load is a fuel valve.

* * * * *